US011205837B2

(12) United States Patent
Zhu et al.

(10) Patent No.: US 11,205,837 B2
(45) Date of Patent: Dec. 21, 2021

(54) TUNABLE ANTENNA SYSTEM FOR SMART WATCH

(71) Applicant: Google LLC, Mountain View, CA (US)

(72) Inventors: Jiang Zhu, Cupertino, CA (US); Maryam Tabesh, San Francisco, CA (US)

(73) Assignee: Google LLC, Mountain View, CA (US)

( * ) Notice: Subject to any disclaimer, the term of this patent is extended or adjusted under 35 U.S.C. 154(b) by 57 days.

(21) Appl. No.: 16/400,083

(22) Filed: May 1, 2019

(65) Prior Publication Data

US 2019/0363428 A1 Nov. 28, 2019

Related U.S. Application Data

(60) Provisional application No. 62/674,681, filed on May 22, 2018.

(51) Int. Cl.

| | |
|---|---|
| ***H01Q 1/27*** | (2006.01) |
| ***H01Q 23/00*** | (2006.01) |
| ***H01Q 5/30*** | (2015.01) |

(52) U.S. Cl.

CPC ..... *H01Q 1/273* (2013.01); *H01Q 5/30* (2015.01); *H01Q 23/00* (2013.01)

(58) Field of Classification Search

CPC ..... H01Q 1/27; H01Q 1/273; H01Q 5/20; H01Q 5/30; H01Q 23/00

See application file for complete search history.

(56) References Cited

U.S. PATENT DOCUMENTS

| | | | | |
|---|---|---|---|---|
| 2015/0091766 | A1 | 4/2015 | Ali et al. | |
| 2015/0171916 | A1* | 6/2015 | Asrani | H04M 1/0202 455/575.7 |
| 2016/0261023 | A1 | 9/2016 | Di Nallo et al. | |
| 2017/0358850 | A1* | 12/2017 | Vanjani | H01Q 1/521 |
| 2018/0069616 | A1* | 3/2018 | Kim | H04L 5/001 |
| 2018/0287248 | A1* | 10/2018 | Han | H01Q 13/10 |

OTHER PUBLICATIONS

International Search Report and Written Opinion for International Application No. PCT/US2019/030116 dated Nov. 4, 2019. 16 pages.

International Preliminary Report on Patentability for International Application No. PCT/US2019/030116 dated Dec. 3, 2020. 11 pages.

* cited by examiner

*Primary Examiner* — Jimmy T Vu

(74) *Attorney, Agent, or Firm* — Lerner, David, Littenberg, Krumholz & Mentlik, LLP

(57) ABSTRACT

A tunable antenna system is provided for a wearable personal computing device, such as a smartwatch. The tunable antenna system includes at least two antennas configured for respective sets of frequency ranges. One or more radiating elements of the antennas are formed from portions of a metal bezel of the wearable personal computing device. For at least one of the antennas, an aperture tuner and an impedance tuner positioned within the metal bezel are provided, e.g., to tune between various communication bands. Non-conductive slits may be positioned within the metal bezel to provide isolation between the antennas. A ground plane of the antenna system may be formed by a metallic component of the wearable personal computing device. The antenna system can be insulated from a wearer's skin by a non-metallic back cover and optionally a glass back plate arranged to contact the wearer's skin or clothing during use.

19 Claims, 9 Drawing Sheets

300

400

TUNABLE ANTENNA SYSTEM FOR SMART WATCH

CROSS-REFERENCE TO RELATED APPLICATIONS

This application claims the benefit of the filing date of U.S. Provisional Patent Application No. 62/674,681 filed May 22, 2018, the disclosure of which is hereby incorporated herein by reference.

BACKGROUND

Portable electronic devices include one or more antennas for transmitting and receiving signals in various communication bands. Antenna design for small electronic devices, such as wearable devices, can be very challenging because of the constrained form factors of such devices. For example, while a smart phone may have limited space for housing its antennas, a smartwatch with a compact form factor would necessarily have even less space. The limited space often impacts antenna performance, which may be measured by radiation efficiency and bandwidth. Further, antenna performance for wearable devices may be severely impacted by body effects due to the close proximity to the wearer, which may cause detuning, attenuation, and shadowing of the antenna. While coverage of WiFi and GPS signals may require covering only two communication bands, coverage of LTE signals may require covering many communication bands, such as various communication bands within the low-band LTE frequency range between 700 MHz and 960 MHz, mid-band LTE frequency range between 1710 MHz to 2200 MHz, and high-band LTE frequency range between 2500 MHz and 2700 MHz.

BRIEF SUMMARY

The present disclosure provides for a tunable antenna system for a wearable personal computing device, comprising a first antenna configured for a first set of frequency ranges, a second antenna configured for a second set of frequency ranges, an impedance tuner configured to tune the second antenna, an aperture tuner configured to tune the second antenna, a metal bezel disposed along a housing of the wearable personal computing device, wherein portions of the metal bezel form one or more radiating elements of the first antenna and one or more radiating elements of the second antenna, and wherein the impedance tuner and the aperture tuner are positioned within the metal bezel, a first non-conductive slit positioned within the metal bezel between a second end of the first antenna and a first end of the second antenna, and a second non-conductive slit positioned within the metal bezel between a second end of the second antenna and a first end of the first antenna. The aperture tuner and the impedance tuner to be positioned within the metal bezel may for example be provided for tuning between various communication bands.

The first non-conductive slit may be in contact with the second end of the first antenna and the second non-conductive slit may be in contact with the second end of the second antenna. At least one of the first non-conductive slit or the second non-conductive slit may have a width within a range of 1 mm-1.5 mm. The first non-conductive slit and second non-conductive slit may be positioned symmetrically around the metal bezel.

A clearance between a ground plane of the wearable personal computing device, (to which ground plane at least one of the first and second antennas is to be connected) and at least one of the first antenna or the second antenna may be within a range of 0.8 mm-2 mm. The ground plane of the wearable personal computing device may have a dimension (such as length, width, or diameter) of less than 40 mm.

The second set of frequency ranges may include one or more frequency ranges between 700 MHz and 2200 MHz for LTE signals. The second set of frequency ranges may also include one or more frequency ranges between 2500 MHz and 2700 MHz for LTE signals. The first set of frequency ranges may include one or more frequency ranges centered at 1575.42 MHz for GPS signals, or between 2400 MHz and 2484 MHz for WiFi signals.

At least one of the impedance tuner or the aperture tuner may be an active tuner.

The present disclosure further provides for a wearable electronic device, comprising a display device having a front cover configured to present information to a wearer of the wearable electronic device, a housing having a first side attached to the front cover, the housing having a metal bezel therein, a plurality of antennas, wherein portions of the metal bezel form one or more radiating elements of the plurality of antennas, one or more non-conducive slits positioned within the metallic bezel between each of the antennas, and a non-metallic back cover attached to a second side of the housing opposite the front cover.

The wearable electronic device may further comprise a glass back plate attached to the non-metallic back cover remote from the front cover, the glass back plate being configured to contact a portion of a wearer of the wearable electronic device during use.

At least one of the one or more non-conductive slits may have a width within a range of 1 mm-1.5 mm. The first non-conductive slit and second non-conductive slit may be positioned symmetrically around the metal bezel.

A clearance between a ground plane of the wearable electronic device and the plurality of antennas may be within a range of 0.8 mm-2 mm. A ground plane of the wearable electronic device may have a dimension (such as a length, width, or diameter) of less than 40 mm.

The wearable electronic device may further comprise one or more impedance tuners positioned within the metal bezel, the one or more impedance tuners being operatively connected to the plurality of antennas. The one or more impedance tuners may be operatively connected to one or more feeds of the plurality of antennas.

The wearable electronic device may further comprise one or more aperture tuners positioned within the metal bezel, the one or more aperture tuners operatively connected to the plurality of antennas. The one or more aperture tuners may be positioned inside the one or more radiating elements of the plurality of antennas.

DETAILED DESCRIPTION

Overview

Figure 1:
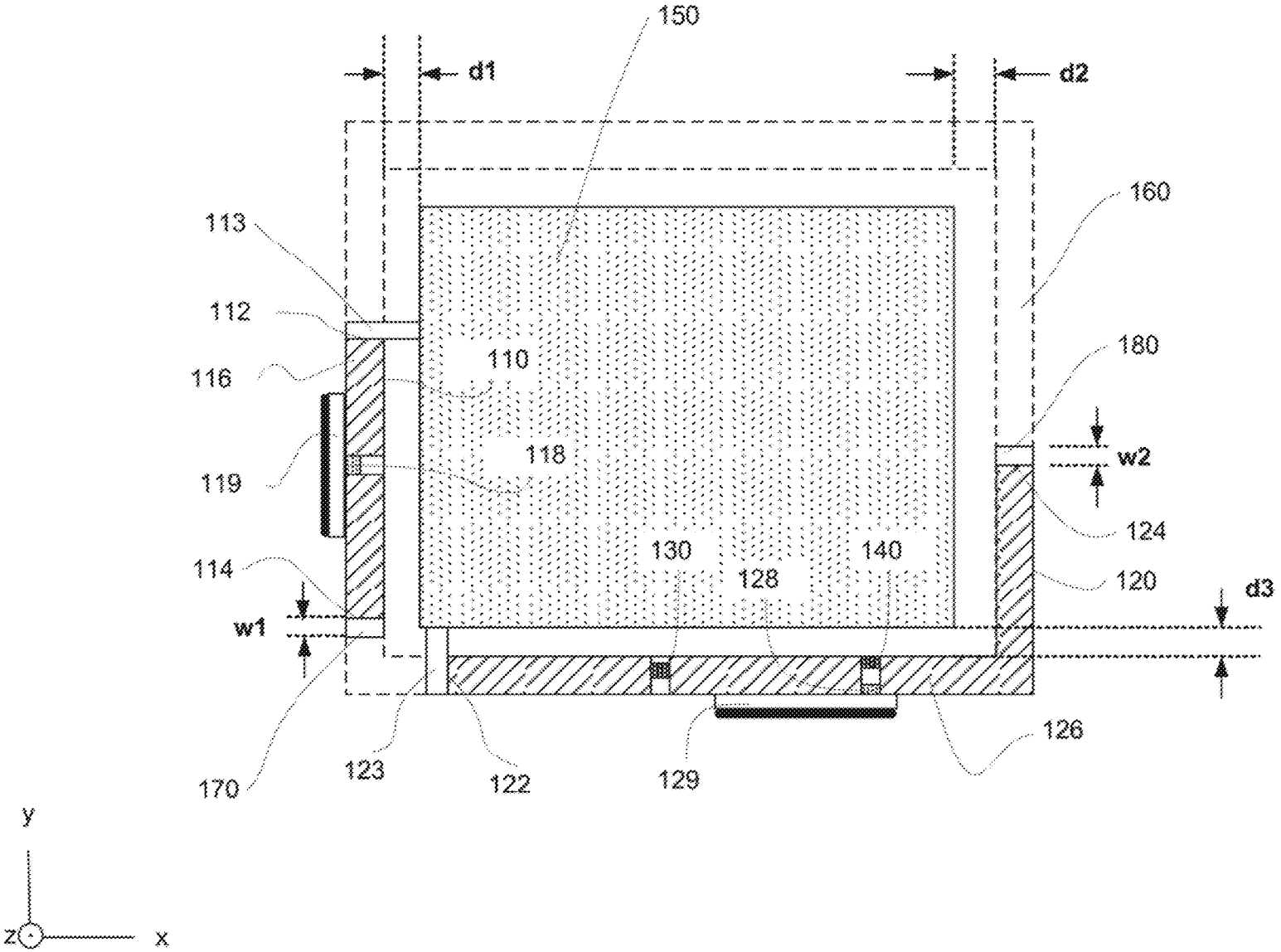
FIG. 1 is a block diagram illustrating an example antenna system in accordance with aspects of the disclosure.

The technology generally relates to a tunable antenna system for a wearable device, such as a smartwatch. Antenna design for small electronic devices may be very challenging because of the small form factors of such devices. For instance, because of limited space in a smartwatch, the size of the antenna ground plane may be smaller or comparable to a quarter wavelength of the signals that the antenna is designed to receive/transmit. This means that the ground plane would be strongly excited and become part of the radiating element of the antenna. For example, for a smartwatch the size of the ground plane is limited by the dimensions of the smartwatch, such as 40 mm (length, width, or diameter of the watch). However, the free space wavelength of low-band LTE signals at 750 MHz is 400 mm. Thus, the size of the ground plane at 40 mm is less than 100 mm (the quarter wavelength of these 750 MHz signals). For another example, even at the high end of mid-band LTE frequencies such as 2200 MHz, where the free wavelength is about 136 mm, the quarter wavelength at this frequency, 34 mm, is still comparable to the 40 mm ground plane.

In addition, the clearance between the antenna and the ground plane within the smartwatch form factor may also be very small, for example around 1 mm, which can also negatively affect antenna performance. Furthermore, when multiple antennas are employed in a wearable device for receiving/transmitting at different frequency ranges (such as WiFi/GPS, LTE), the small clearance may cause unwanted coupling between the various antennas. The small form factor also limits the space available for including tuners for the antennas, which may be necessary in order to achieve coverage of many communication bands is required, for example, bands required by major LTE carriers may include LTE bands B5, B8, B12, B13, and B17 in the low-band LTE ranges, LTE bands B2 and B4 in the mid-band LTE ranges, and LTE bands B40, B41, and B7 of the high-band LTE ranges. To provide coverage of many communication bands, one or more tuners may be provided to tune the antenna between various resonance frequencies and to reduce mismatch.

Also, due to the close proximity to a portion of the wearer's body, antenna performance for a wearable device may be severely impacted by body effects, which may cause detuning, attenuation, and shadowing of the antenna.

In one example, an antenna system is provided with two antennas. The two antennas are configured to cover respective sets of frequency ranges. For example, one antenna may be configured for a first set of frequency ranges (such as WiFi and GPS frequency ranges), while the other antenna may be configured for a second set of frequency ranges (such as various LTE frequency ranges). For at least one of the antennas, one or more tuners are provided to tune between various communication bands. For example, an aperture tuner and an impedance tuner may be provided for the antenna configured for the larger set of frequency ranges. The antenna system may be implemented in a ring-like or arcuate-type configuration. This way, the antenna system may be housed in a periphery of a small electronic device, for example implemented as part of a metal bezel of a smartwatch, where radiating elements of the antenna system can be formed from portions of the metal bezel. Such an arrangement not only saves space, but can also reduce interference between the antenna system in the periphery and other electronic components at the center of the electronic device. Non-conductive slits may be positioned within the metal bezel to provide isolation between the portions of the metal bezel that form radiating elements of the antennas.

In another example, a wearable device is provided with an antenna system having one or more antennas and one or more tuners. The wearable device includes a front cover of a display device configured to present information to the wearer of the wearable electronic device. A housing is attached to the cover for supporting various mechanical and/or electronic components, including the antenna system. A metal bezel is provided within the housing such that the radiating elements of the antenna system may be formed from the metal bezel. If multiple antennas are included in the wearable device, one or more non-conducive slits can be positioned within the metal bezel to isolate the portions of the metal bezel that form radiating elements of the antennas. A ground plane for the antenna system may be formed by a metallic component of the wearable personal computing device, such as a circuit board with a shielded can. A non-metallic back cover is attached to the housing for insulating the various electronic components, including the antenna system, from the wearer's skin or clothing. Optionally, a glass or other non-conductive back plate is attached to the non-metallic back cover to provide further insulation between the various electronic components and the wearer's skin or clothing.

In summary, the technology is advantageous because it provides an efficient antenna system for a small factor wearable electronic device. Features of the antenna system provide for tuning between different communication bands, reduced interference from other components in the wearable electronic device, reduced coupling between different antennas, and greater isolation from the body effects of the wearer.

Example Systems

FIG. 1 shows an example antenna system 100 according to aspects of the disclosure. The antenna system 100 includes a first antenna 110 and a second antenna 120. The first antenna 110 and the second antenna 120 may be any type of antenna, for example, a monopole antenna, a dipole antenna, a planar antenna, a slot antenna, a hybrid antenna, a loop antenna, an inverted-F antenna, etc. The first antenna 110 and the second antenna 120 may be made of any of a number of conductive materials, for example, metals and alloys.

The first antenna 110 has a first end 112 and a second end 114. The first antenna 110 may have one or more radiating elements 116. For example, the one or more radiating elements 116 may extend from the first end 112 to the second end 114 of the first antenna 110. Likewise, the second antenna 120 also has a first end 122 and a second end 124, and one or more radiating elements 126. For example, the one or more radiating elements 126 may extend from the first end 122 to the second end 124 of the second antenna 120. The radiating elements 116 and 126 are configured to support the currents or fields that contribute directly to the radiation patterns of the antennas 110 and 120, respectively.

The first antenna 110 may have one or more antenna feeds. For example, antenna feed 118 may be positioned between the first end 112 and the second end 114 of antenna 110. Likewise, the second antenna 120 may have one or more antenna feeds. For example, antenna feed 128 may be positioned between the first end 122 and the second end 124 of the second antenna 120. The antenna feeds 118 and 128 are configured to feed the radio waves to the rest of the antenna structure of the first and second antennas 110 and 120, respectively, or collect the incoming radio waves, convert them to electric currents and pass the currents to one or more receivers. In this regard, the antenna feeds 118 and 128 may be connected to an antenna control circuit (not shown in FIG. 1, shown as 558 in FIG. 5).

The antenna control circuit is configured to capacitively feed the antennas 110 and 120 at the antenna feeds 118 and 128, respectively, via one or more feed structures 119, 129 positioned proximate to the antenna feeds 118 and 128. For example, the feed structure 119 may be a non-conductive plate having a first surface in contact with the antenna feed 118, and a second surface opposite the first surface, the second surface is coated with a conductive material (shown as bolded line on the second surface). This way, the antenna feed 118 and the second surface of the feed structure 119 form a parallel plate capacitor through which the antenna control circuit (not shown in FIG. 1, shown as 558 in FIG. 5) may feed the first antenna 110. Likewise, the feed structure 129 may also be a non-conductive plate having a first surface in contact with the antenna feed 128, and a second surface opposite the first surface, the second surface is coated with a conductive material (shown as bolded line on the second surface). This way, the antenna feed 128 and the second surface of the feed structure 129 form a parallel plate capacitor through which the antenna control circuit (not shown in FIG. 1, shown as 558 in FIG. 5) may feed the second antenna 120. Such capacitive feeding may reduce antenna size, and increase the antenna efficiency and specific absorption rate. The antenna feeds 118 and 128 may be connected to one or more transceivers (not shown).

The first end 112 of the first antenna 110 may be connected to a ground plane 150. In this regard, an electrical connection 113 may be provided to short the first end 112 of the first antenna 110 to the ground plane 150. Likewise, the first end 122 of the second antenna 120 may be connected to a ground plane, for example, the same ground plane 150 that the first antenna 110 is connected to. An electrical connection 123 may be provided to short the first end 123 of the second antenna 120 to the ground plane 150. This way, with limited space, a larger ground plane 150 may be shared by both antennas 110 and 120, as opposed to having two smaller, discrete ground planes. The ground plane 150 is a conducting surface that serves as a reflecting surface for radio waves received and/or transmitted by the first and second antennas 110 and 120. In addition, by positioning the two electrical connections 113 and 123 at the first ends 112, 122 of the two antennas 110 and 120, they may also act as one of the antenna openings for the two antennas 110 and 120 (e.g., boundary conditions where the antennas 110 and 120 either begin or end).

The first antenna 110 is configured for a first set of frequency ranges. For instance, the first set of frequency ranges may include WiFi or GPS frequency ranges, such as a frequency range between 2400 MHz and 2484 MHz for WiFi signals, and a frequency range centered about 1575.42 MHz for GPS signals. When the first antenna 110 is configured for such a small number of communication bands, tuners are not needed. This allows the first antenna 110 to have compact dimensions within the housing of the wearable device.

The second antenna 120 is configured for a second set of frequency ranges, which may be different from the first set of frequency ranges. For instance, the second set of frequency ranges may include a large number of communication bands. In one example, the second set of frequency ranges includes communication bands in the low-band LTE frequency ranges, such as LTE bands between 700 MHz and 960 MHz, and mid-band LTE frequency ranges, such as LTE bands between 1710 MHz to 2200 MHz. When the second antenna 120 is configured for such a large number of communication bands, one or more tuners are employed to switch between the various resonant frequencies of the second antenna 120. The one or more tuners thus ensure coverage of the many communication bands within these frequency ranges.

To further increase LTE diversity, the second set of frequency ranges for the second antenna 110 may also include high-band LTE frequency ranges, such as LTE bands between 2500 MHz and 2700 MHz. Alternatively, the first set of frequency ranges for the first antenna 120 may further include such high-band LTE frequency ranges.

In this regard, an aperture tuner 130 and an impedance tuner 140 are provided for tuning the second antenna 120 between the different communication bands in the second set of frequency ranges. The aperture tuner 130 is connected to the second antenna 120 to change the aperture size of the second antenna 120, which affects the resonant frequency of the second antenna 120. As shown, the aperture tuner 130 is positioned inside the one or more radiating elements 126. Positioning of the aperture tuner 130 inside the one or more radiating elements 126 may be selected such that the aperture tuner 130 is at a location where the current and/or field distribution is relatively stronger than other locations of the one or more radiating elements 126.

The impedance tuner 140 is connected to the second antenna 120 to fine-tune its impedance for better matching with the desired communication band. As shown, the impedance tuner 140 is implemented at the antenna feed 128 of the second antenna 120. Additionally or alternatively, a pre-matching circuit (not shown) may be connected between the antenna feed 128 and the impedance tuner 140 to customize the impedance tuner 140 as needed. The aperture tuner 130 and the impedance tuner 140 may improve frequency match, antenna efficiency, and reduce specific absorption rate even when the size of the ground plane 150 is comparable to or smaller (e.g., 40 mm in length, width, or diameter) than the quarter wavelengths of the low-band LTE or mid-band LTE signals, and a clearance between the ground plane 150 and one or both of the antennas 110 and 120 is as small as 1 mm.

Figure 5:
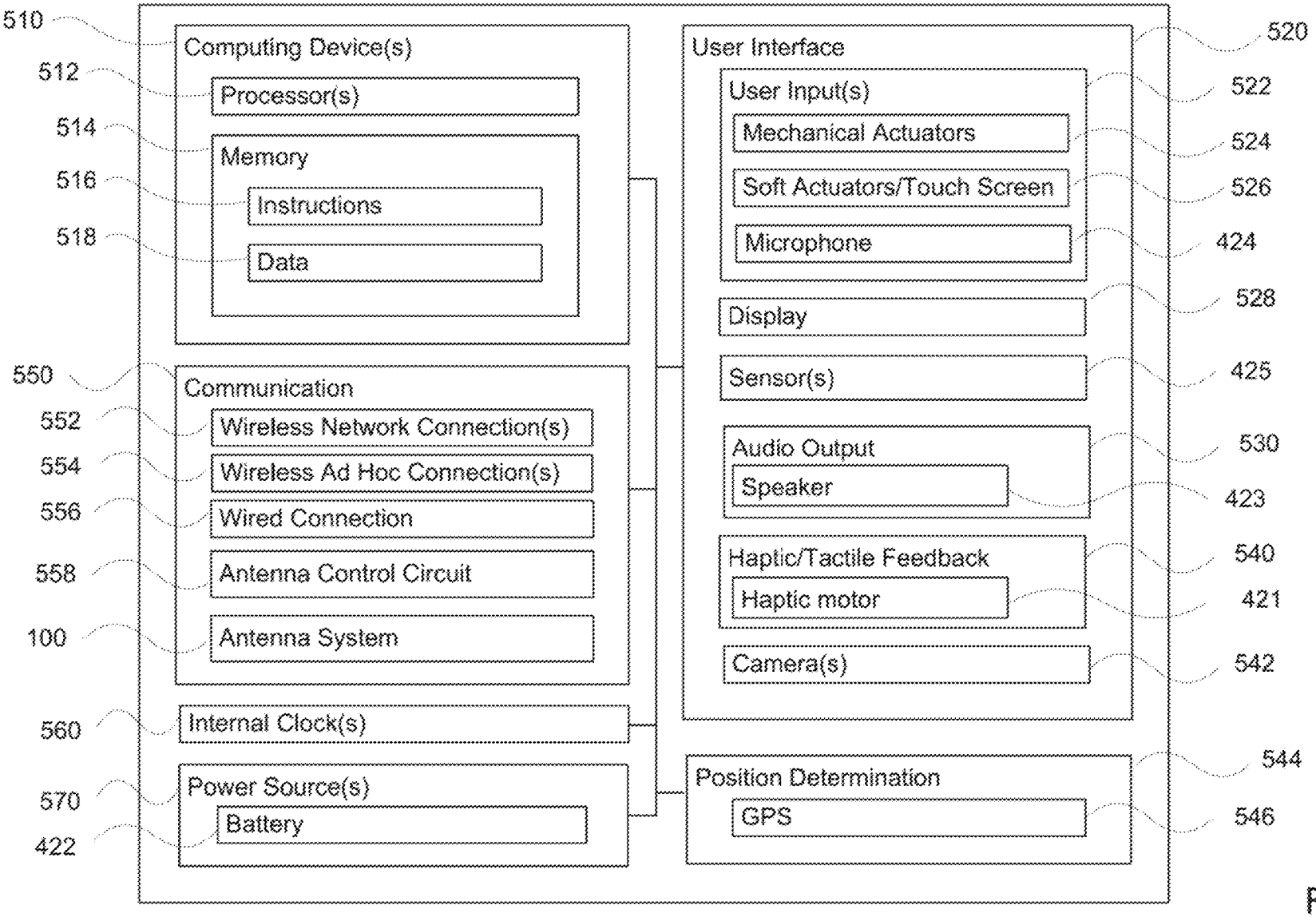
FIG. 5 is a block diagram illustrating an example system in accordance with aspects of the disclosure.

The aperture tuner 130 and the impedance tuner 140 may be active tuners controlled by the antenna control circuit (not shown in FIG. 1, shown as 558 in FIG. 5). In this regard, the aperture tuner 130 and the impedance tuner 140 may tune between different communication bands based on any of a number of network requirements, such as signal strength and user traffic. For example, the aperture tuner 130 may be configured such that, when signal strength drops below a low quality threshold for the LTE band that the second antenna 120 is currently tuned to, the aperture tuner 130 may change the aperture of the second antenna 120 to tune it to a different resonant frequency so that the second antenna 120 is configured to receive and transmit signals at another LTE band around this new resonant frequency. For instance, the aperture tuner 130 may be configured such that, when a threshold amount of users are communicating using the particular LTE band that the second antenna 120 is currently tuned to, the aperture tuner 130 may change the aperture of the second antenna 120 to a different resonant frequency, so that the second antenna 120 may receive and transmit signals with a different LTE band around this new resonant frequency. The impedance tuner 140 may be configured such that, when a switch of resonant frequency is made, the impedance tuner 140 fine tunes the second antenna 120 around this new resonant frequency to a particular LTE band having a desired signal strength, and/or to reduce mismatch with the particular LTE band.

The example antenna system 100 described above may be implemented in a ring-like or arcuate-type configuration. This way, the antenna system 100 may be housed in a periphery of a small electronic device, such as a smartwatch or a smart phone. Such an arrangement not only saves space, but may also reduce interference between the antenna system 100 in the periphery and other electronic components at the center of the electronic device. For example, parts of the antenna system 100 may be formed from a metal bezel 160 (shown as dashed lines). For example, portions of the metal bezel 160 (shaded portions of the metal bezel) may form the radiating elements 116 and 126. This way, the radiating elements 116 and 126 are formed from the metal bezel 160 itself, as opposed to requiring additional dedicated elements. The aperture tuner 130 and the impedance tuner 140 may be positioned within the metal bezel 160. Although the metal bezel 160 is shown as a rectangle, the metal bezel may alternatively be any of a number of geometric shapes, for example, a square, a circle, an oval, a triangle, or any other polygon.

To operationally separate the first antenna 110 and the second antenna 120, two non-conductive slits 170 and 180 may be positioned within the metal bezel 160 to isolate the portion of the metal bezel 160 that forms the radiating element 116 from the portion of the metal bezel 160 that forms the radiating element 126. The non-conductive slits 170 and 180 may be made of any of a number of non-conductive materials, such as a plastic, a ceramic, a glass material or combinations thereof. As shown, the first non-conductive slit 170 is positioned between the second end 114 of the first antenna 110 and the first end 122 of the second antenna 120, while the second non-conductive slit 180 is positioned between the second end 124 of the second antenna 120 and the first end 112 of the first antenna 110. By positioning the two non-conductive slits 170 and 180 at the ends of the two antennas 110 and 120, they may also act as antenna openings for the two antennas 110 and 120 (e.g., boundary conditions where the antennas 110 and 120 either begin or end). Thus, the first antenna 110 is bounded by the electrical connection 113 and the first non-conductive slit 170, while the second antenna 120 is bounded by the electrical connection 123 and the second non-conductive slit 180.

As the dimensions of the metal bezel 160 are constrained by the overall size of the electronic device, for example, 40 mm in length, width, or diameter, or for example 1600 $mm^2$ in surface area, the dimensions of the first antenna 110 and the second antenna 120 are similarly constrained. For example, the first antenna 110 may have a width (x-direction) of 1 mm-5 mm, a length (y-direction) of 10-50 mm, and a height (z-direction) of 1 mm-5 mm. For another example, the second antenna 120 may have a width (x-direction near second end 124 or y-direction near first end 122) of 1 mm-5 mm, a length (x-direction near first end 122 or y-direction near second end 124) of 10 mm-50 mm, and a height (z-direction) of 1 mm-5 mm. For yet another example, the non-conductive slits 170 and 180 may each have a width, w1 (measured along the length of the first antenna 110 in y-direction) and w2 (measured along the length of the second antenna 120 in y-direction) respectively, within a threshold difference of 1 mm, for example within a range of 1 mm-1.5 mm.

Likewise, the dimension of the ground plane 150 may also be constrained by the overall size of the electronic device, for example, 40 mm in length, width, or diameter, or for example 1600 $mm^2$ in surface area. For example, the ground plane 150 may have a length (x-direction) and/or width (y-direction) of 15 mm-45 mm. Clearance distances between the ground plane 150 and each of the first and second antennas 110 and 120 may be within a threshold difference of 1 mm, and may be the same or different from each other. For example, a clearance distance (x-direction) between the ground plane 150 and the first antenna 110 may be d1=0.8 mm-2 mm. For another example, a first clearance distance (x-direction) between the ground plane 150 and the second antenna 120 may be d2=0.8 mm-2.0 mm, and a second clearance distance (y-direction) between the ground plane 150 and the second antenna 120 may be d3=0.8 mm-2.0 mm. Although d1, d2, d3 are shown as having either x- or y-components, d1, d2, d3 can also include distance components in the z-direction (for example, as shown in FIG. 4B).

It can be seen that there are tradeoffs between the sizes of the various components of the antenna system 100. For example, increasing the size of the antennas 110 and 120 may mean that the size of the ground plane 150 is constrained, and/or that separation between the two antennas 110 and 120 (for example via non-conductive slits 170, 180) will have to be reduced. For another example, increasing the size of the ground plane 150 may mean that the size of the antennas 110 and 120 will have be limited, and/or that clearance distances between the ground plane 150 and the antennas 110 and 120 will have to be reduced.

Figure 2A:
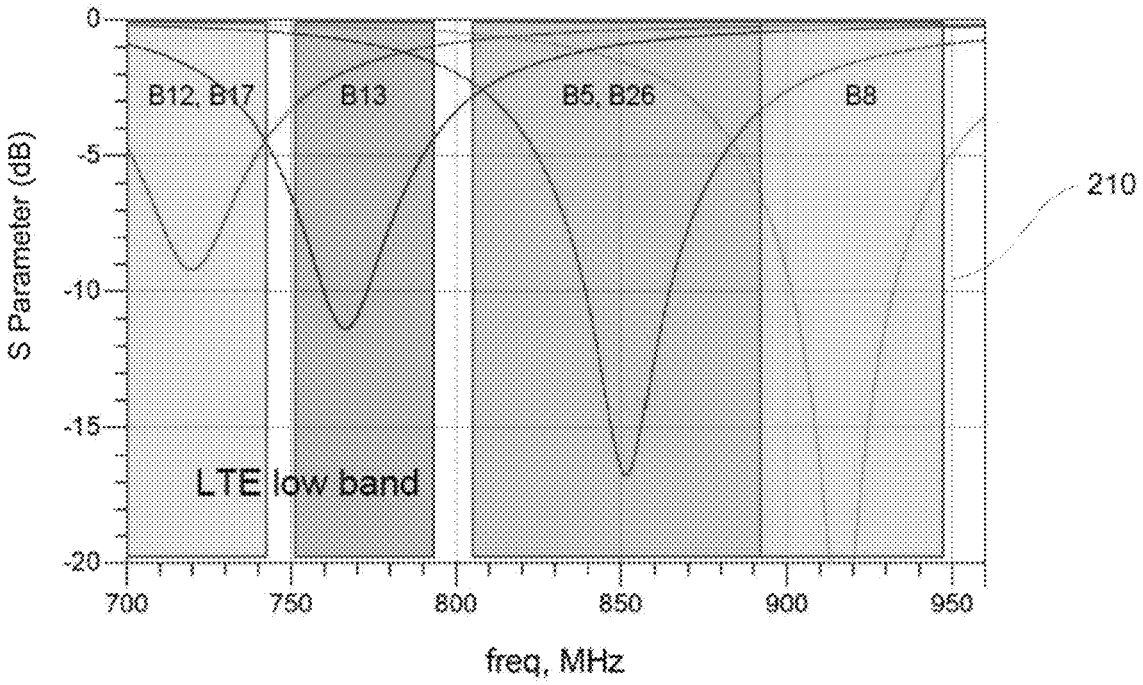
FIGS. 2A-2F are example graphs in accordance with aspects of the disclosure.
Figure 2B:
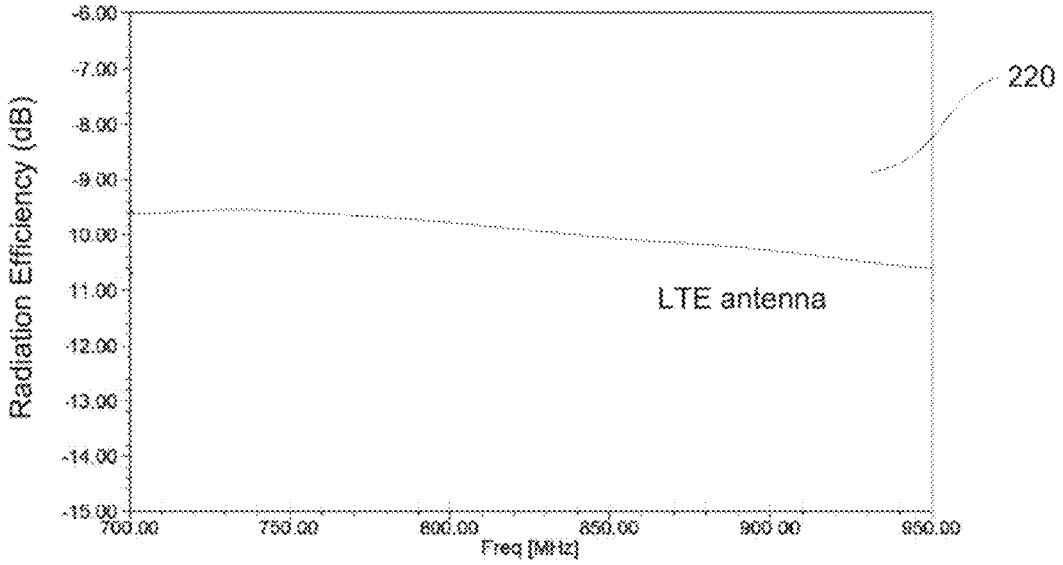
Figure 2C:
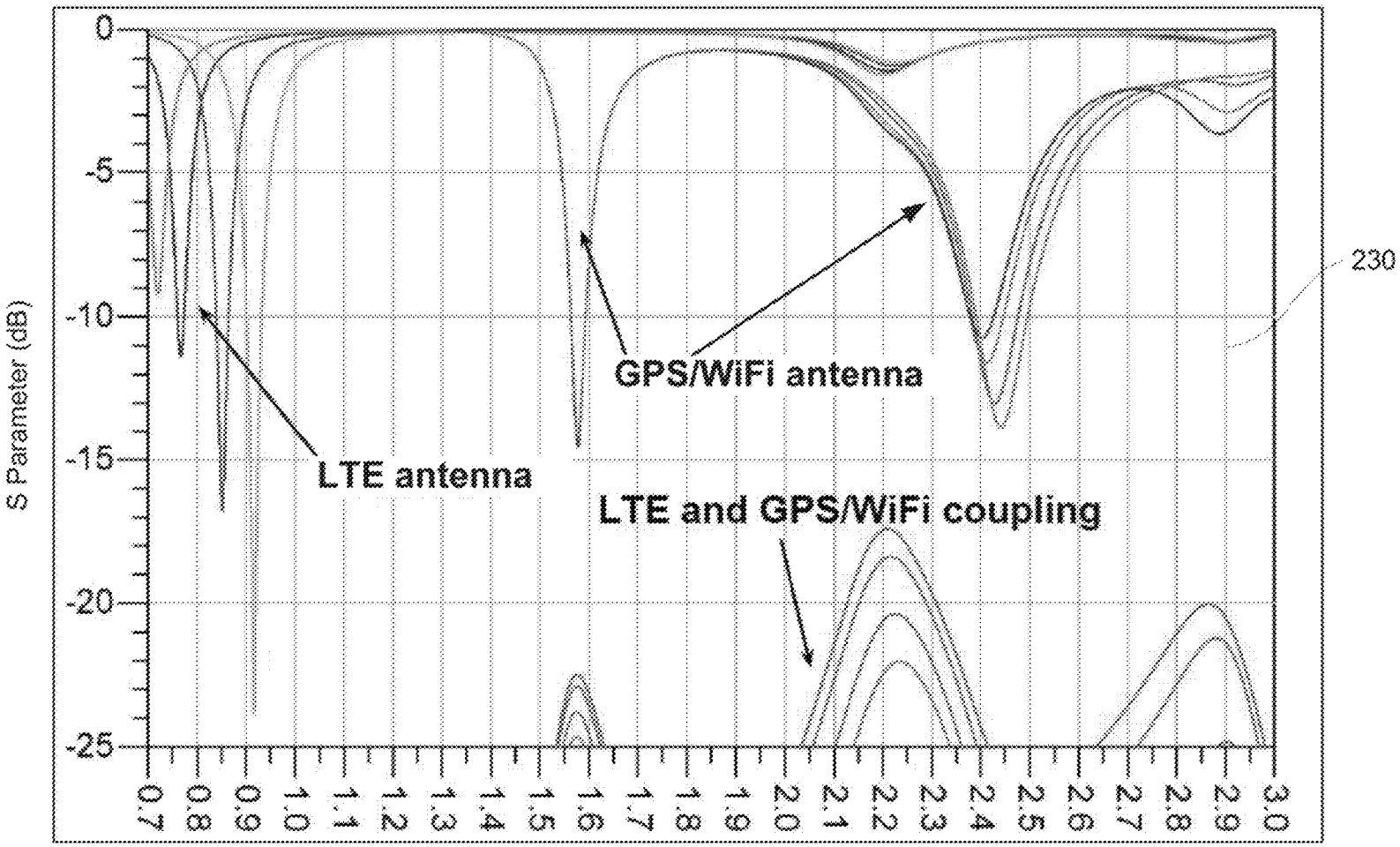
Figure 2D:
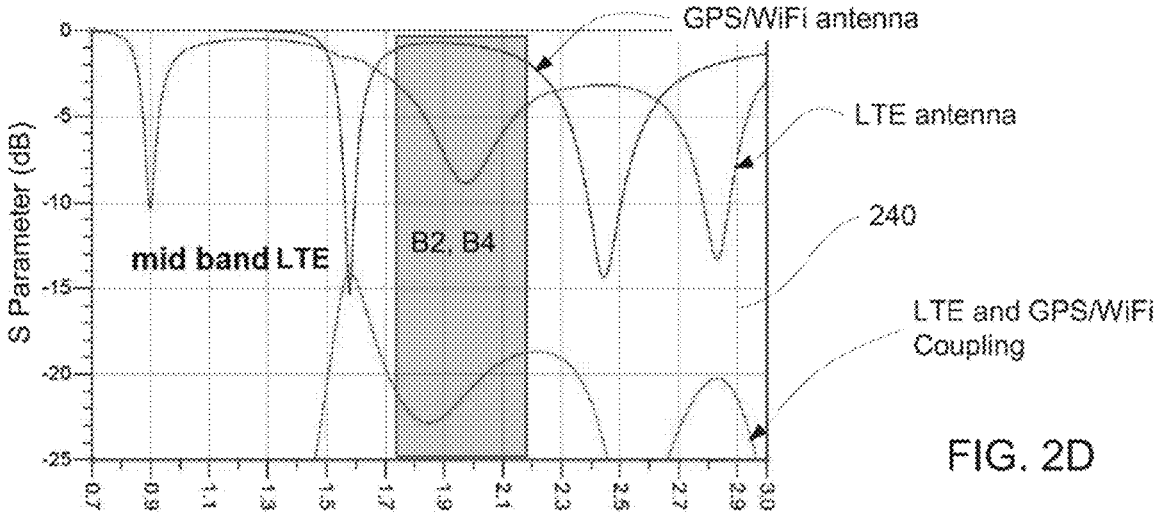
Figure 2E:
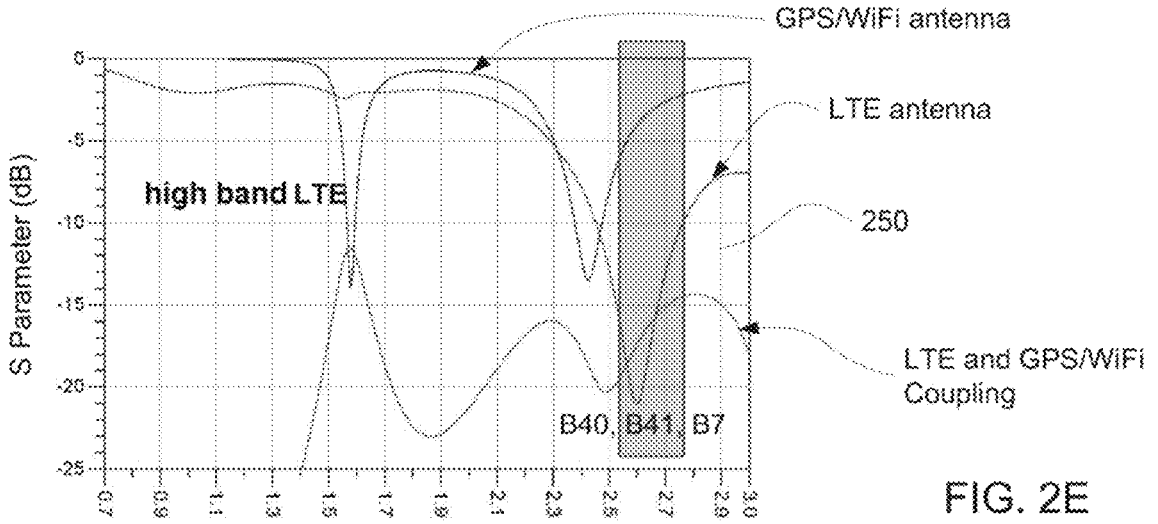
Figure 2F:
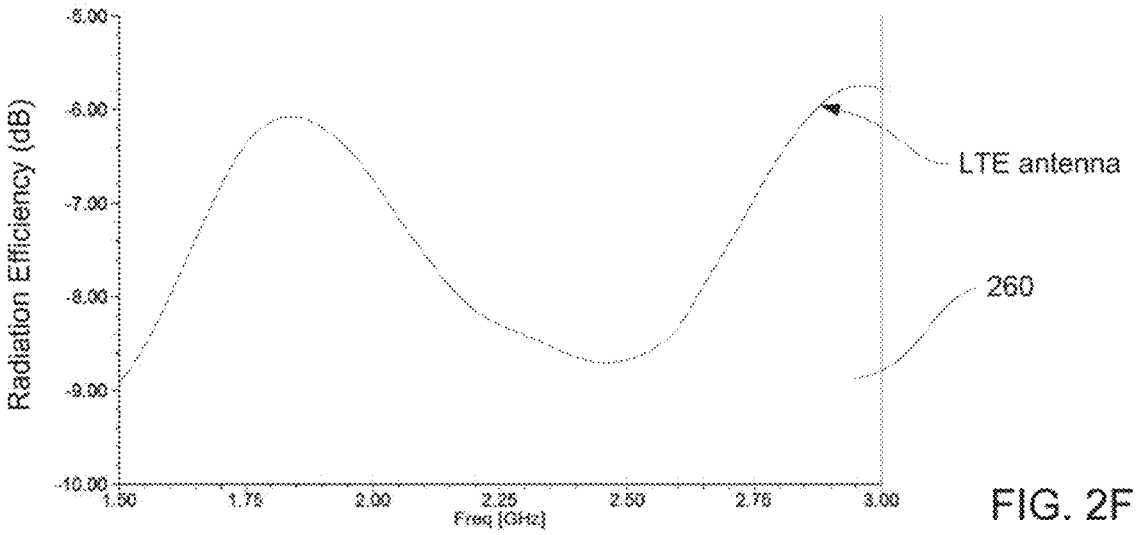

FIGS. 2A-2F show example graphs illustrating example performance of the antenna system 100. FIGS. 2A-2C show example performance graphs 210, 220, and 230 of the antenna system 100 for low-band LTE frequency ranges. FIGS. 2D-2F show example performance graphs 240, 250, and 260 of the antenna system 100 for mid-band and high-band LTE frequency ranges.

Referring to FIG. 2A, graph 210 shows plots of s parameter for the second antenna 120 for the low-band LTE frequency range between 700 MHz-950 MHz. The s parameter for an antenna describes the relationship between the input and the output of the antenna. Here, the s parameter plotted is S11, which is the return loss of the antenna. Thus, as shown in graph 210, the second antenna 120 may be tuned between four resonant frequencies (shown as the four curves having four different troughs) by the aperture tuner 130 and fine-tuned by the impedance tuner 140 to cover most of the low-band LTE frequency range. Each of the four curves thus represent a tuning state of the second antenna 120. The shaded regions indicate various communication bands in the low-band LTE frequency range. Thus, as shown, the four tuning states (four curves) have overlapping troughs that sufficiently cover all the communication bands in the low-band LTE frequency range, including LTE bands B12 and B17 covered by the first trough, band B13 covered by the second trough, bands B5 and B26 covered by the third trough, and band B8 covered by the fourth trough.

Referring to FIG. 2B, graph 220 shows plots of radiation efficiency for the second antenna 120 for the low-band LTE frequency range between 700 MHz-950 MHz. The radiation efficiency of an antenna is a ratio of the power delivered to the antenna relative to the power radiated from the antenna. Thus, as shown in graph 220, the radiation efficiency for the second antenna 120 (LTE antenna) are just above −10 dB for 700 MHz to 840 MHz, and just below −10 dB for 840 MHz to 950 MHz. Depending on the tuned state (by the aperture tuner 130) of the second antenna 120, the radiation efficiency may change slightly. Performance guidelines for a given smartwatch or other wearable device may require −10 dB or greater in radiation efficiency. Thus, in this case the second antenna 120 would provide radiation efficiency around the performance guideline.

Referring to FIG. 2C, graph 230 shows plots of s parameter for the frequency range between 700 MHz-950 MHz. As indicated on graph 230 (and described with respect to graph 210 of FIG. 2A), the four curves marked as "LTE antenna" show the s parameters (S11) for the second antenna 120 about four of its resonant frequencies (four curves having four different troughs). The four curves marked as "GPS/WiFi antenna" show the s parameters for the first antenna 110. Thus, the curves of the first antenna 110 show one trough around 1575.42 MHz for GPS signals, and one trough around 2400 MHz-2484 MHz for WiFi signals. Each of the curves of the first antenna 110 correspond to one of the four curves of the second antenna 120, thus, depending on which resonant frequency the second antenna 120 is tuned to, the s parameter curve of the first antenna 110 may be affected only slightly. The small shifts show that the first antenna 110 remains consistent regardless of the tuned state of the second antenna 120, which is important because it would be undesirable if the performance of the first antenna 110 is strongly affected by the tuning states of the second antenna 120. At the bottom of the plot, coupling between the first antenna 110 and the second antenna 120 are shown for each of the resonant frequencies of the second antenna 120. As shown, there is up to −22 dB of coupling between 1.5-1.65 GHz, up to −17 dB of coupling between 2.0-2.45 GHz, and up to −20 dB of coupling between 2.6-3.0 GHz. Thus, antenna coupling between the first antenna 110 and the second antenna 120 is well below −10 dB (or isolation above 10 dB) for all tuning states of the first antenna 110. This shows performance better than the guideline performance of 10 dB isolation.

Referring to FIG. 2D, graph 240 shows plots of s parameter (S11) of the two antennas 110 and 120 at the top, and the coupling between the two antennas 110 and 120 at the bottom, for the entire LTE frequency range 0.7-3.0 GHz. In graph 240, the second antenna 120 is tuned to a state to cover mid-band LTE frequency range 1.71-2.2 GHz. The shaded region indicates various communication bands in the mid-band LTE frequency range. Thus, as shown, the single tuning state of the second antenna 120 has one trough that sufficiently covers the entire mid-band LTE frequency range, including LTE bands B2 and B4. At the bottom of the graph 240, coupling between the first antenna 110 and the second antenna 120 are shown to fluctuate between −23 dB and −18 dB in the mid-band LTE frequency range. Thus, antenna coupling between the first antenna 110 and the second antenna 120 is well below −10 dB (or isolation above 10 dB). This shows performance better than the guideline performance of 10 dB isolation.

Referring to FIG. 2E, graph 250 shows plots of s parameter (S11) of the two antennas 110 and 120 at the top, and the coupling between the two antennas 110 and 120 at the bottom, for the entire LTE frequency range 0.7-3.0 GHz. In graph 250, the second antenna 120 is tuned to a state that covers high-band LTE frequency range 2.5-2.7 GHz. The shaded region indicates various communication bands in the low-band LTE frequency range. Thus, as shown, the single tuning state of the second antenna 120 has one trough that sufficiently covers the entire high-band LTE frequency range, including LTE bands B40, B41, and B7. At the bottom of the graph 250, coupling between the first antenna 110 and the second antenna 120 are shown to fluctuate between −20 dB and −14 dB in the high-band LTE frequency range. Thus, antenna coupling between the first antenna 110 and the second antenna 120 is well below −10 dB (or isolation above 10 dB). This shows performance better than the guideline performance of 10 dB isolation.

Referring to FIG. 2F, graph 260 shows radiation efficiency of the second antenna 120 (LTE antenna) for the mid-band LTE and high-band LTE frequency ranges 1.5-3.0 GHz. As shown, the radiation efficiency for the second antenna 120 fluctuates between just below −9 dB and just above −6 dB, much better than the performance guideline of −10 dB. Also, it is notable that the radiation efficiency of the second antenna 120 peaks in the mid-band LTE frequency range 1.71 GHz-2.2 GHz.

Figure 3:
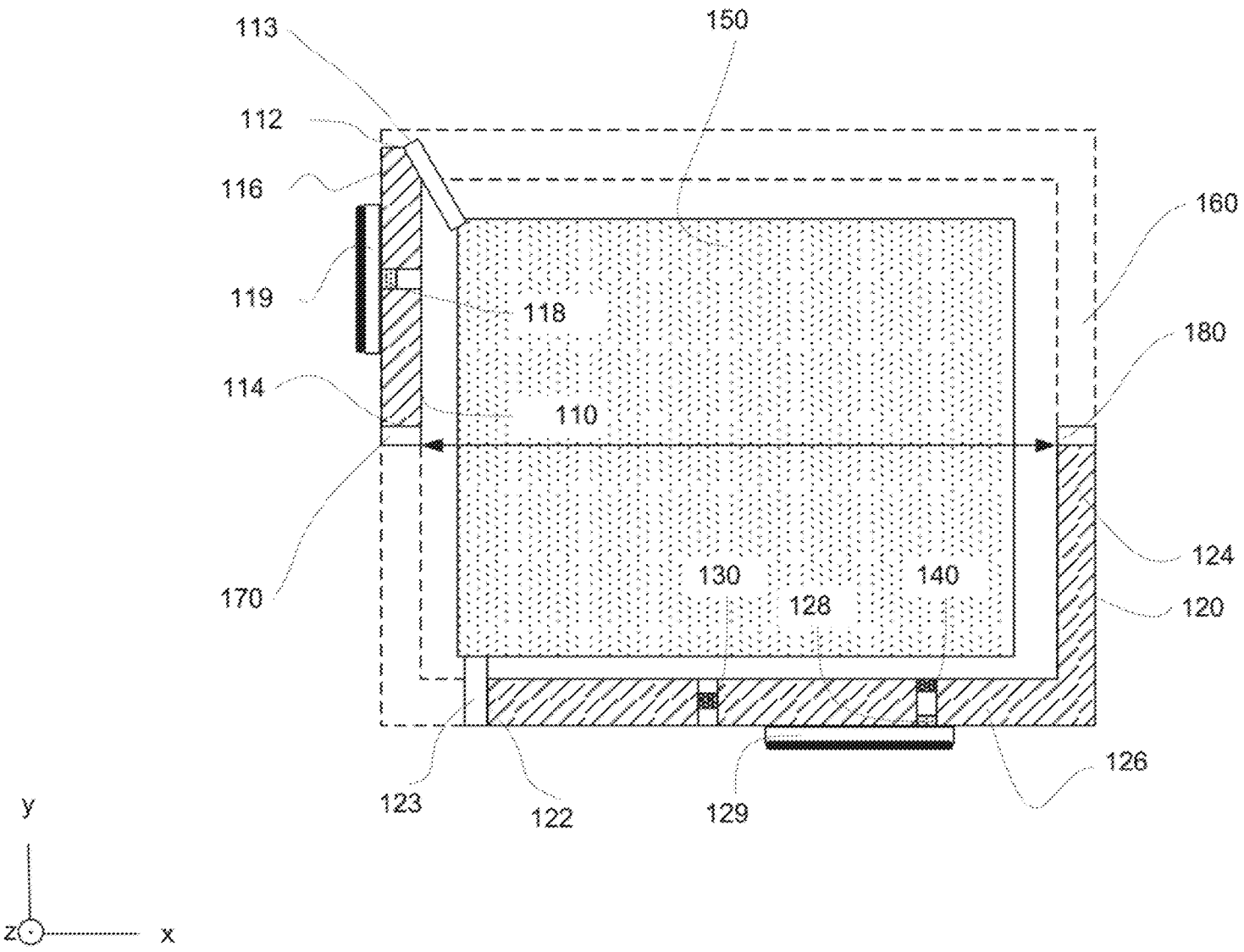
FIG. 3 is a block diagram illustrating another example antenna system in accordance with aspects of the disclosure.

FIG. 3 shows another example antenna system 300 according to aspects of the disclosure. FIG. 3 includes many of the features of example antenna system 100 but with differences. For instance, in antenna system 300, the first antenna 110 and the second antenna 120 are positioned such that the non-conductive slits 170 and 180 are arranged symmetrically about the metal bezel 160. The symmetry of the antenna system 300 may beneficially provide ease of manufacturing and/or a more pleasing aesthetic appearance to the electronic device.

Figure 4A:
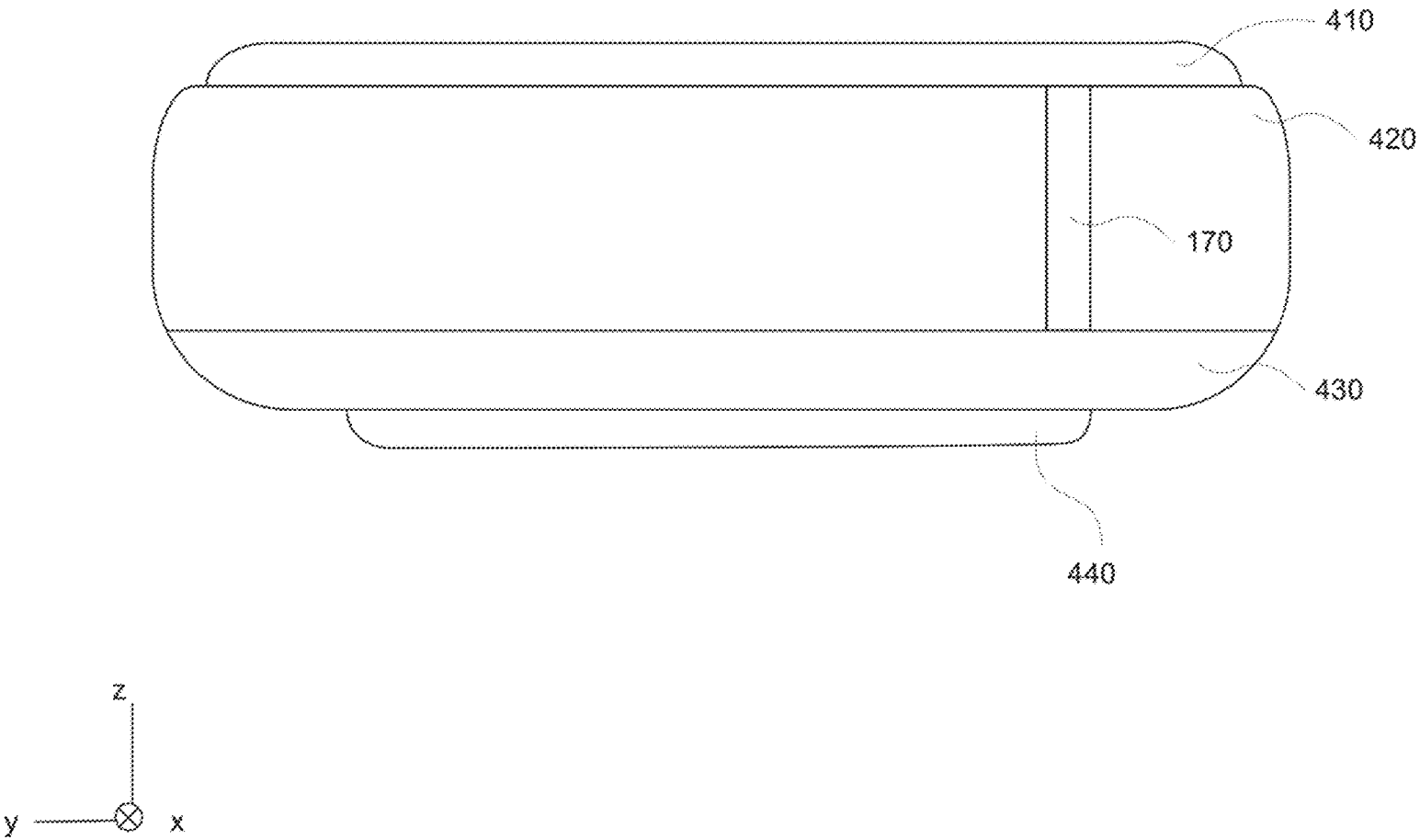
FIGS. 4A-4C are block diagrams illustrating an example device in accordance with aspects of the disclosure.
Figure 4B:
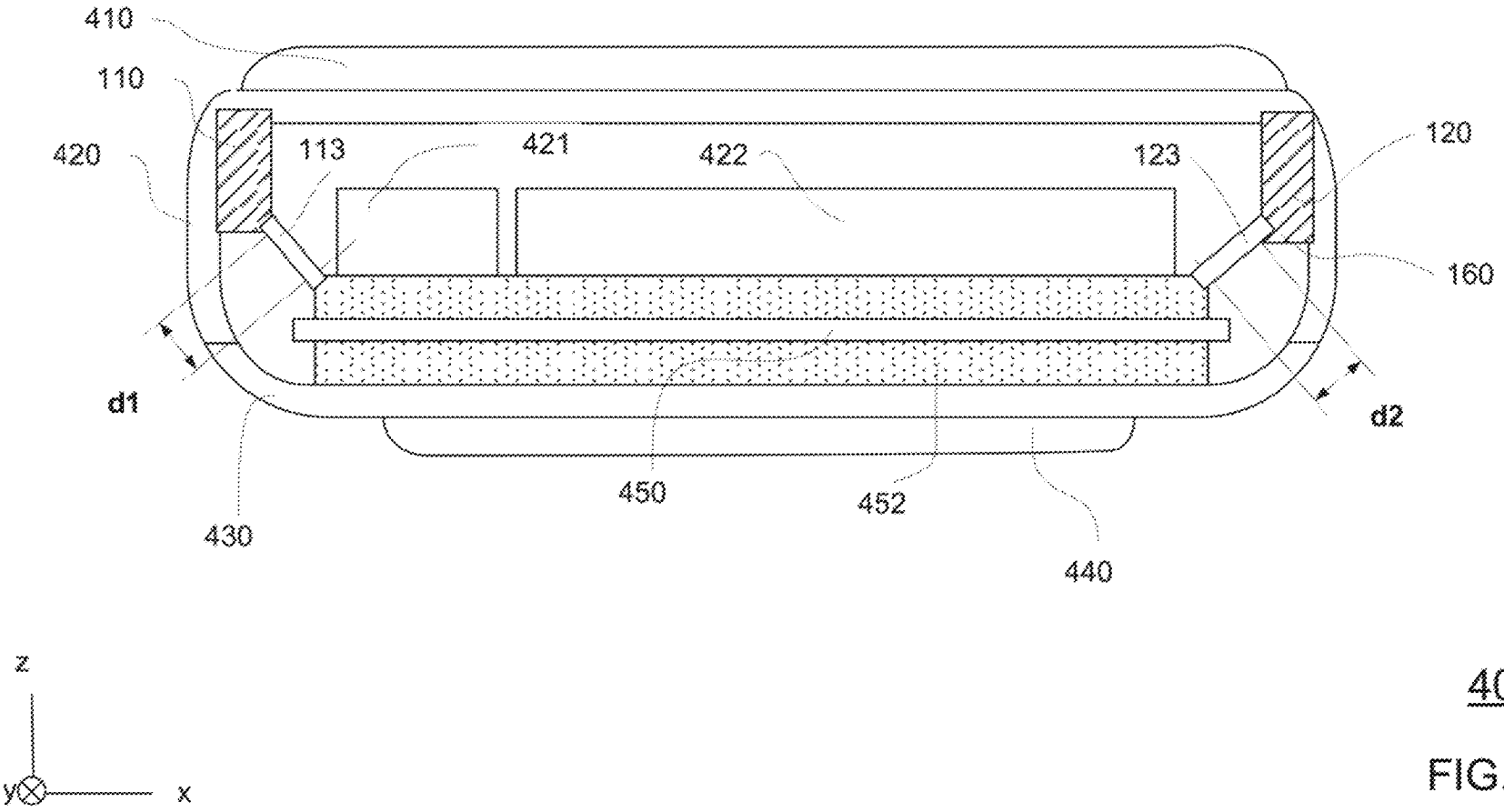
Figure 4C:
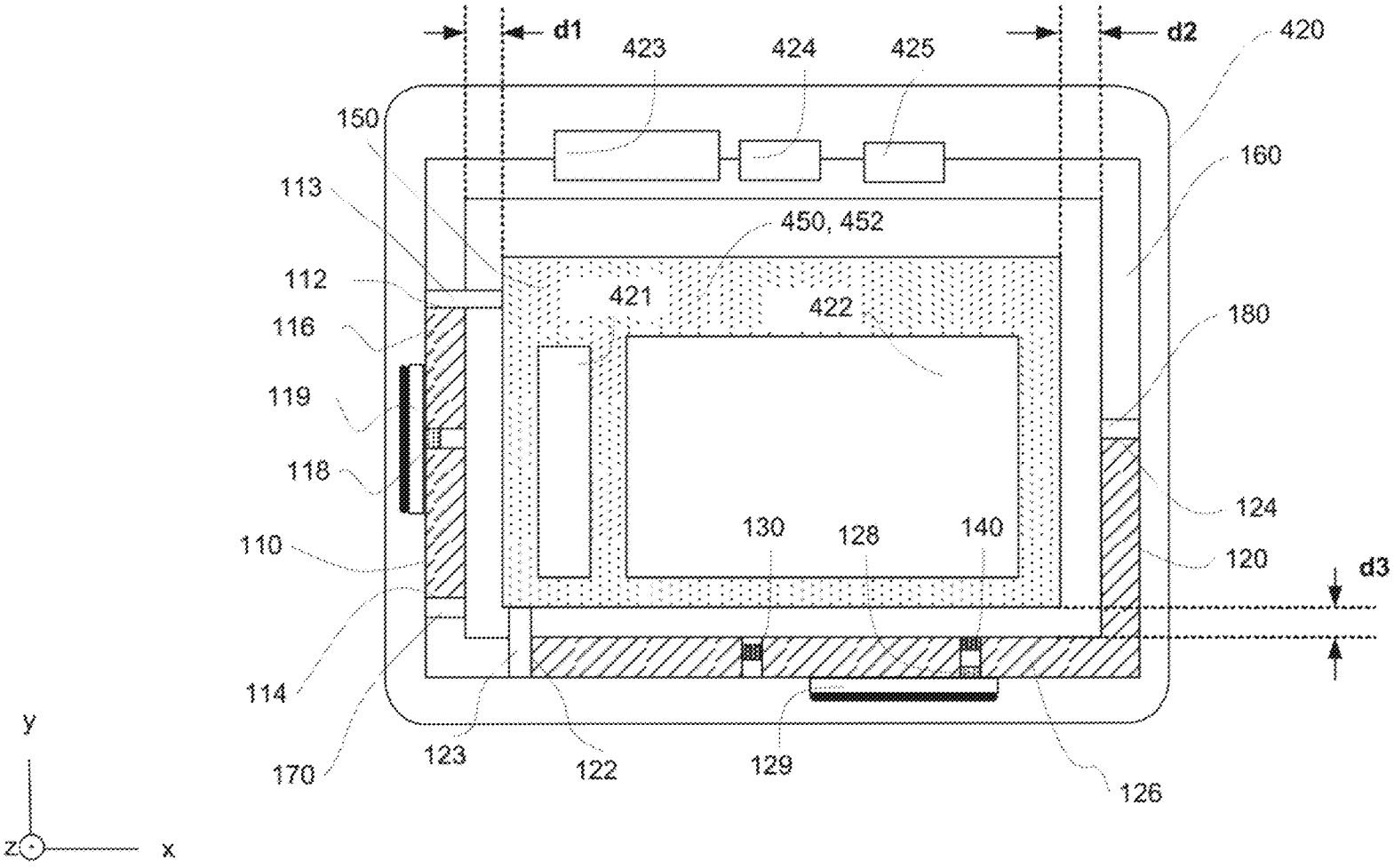

FIGS. 4A-4C show various views of an example wearable device 400 having an antenna system according to aspects of the disclosure. For ease of illustration, a watch strap, band or other connection mechanism is omitted for clarity. The wearable device 400 may be configured to incorporate the antenna system 100. FIG. 4A shows a side view of an exterior of the wearable device 400. FIG. 4B shows a side view of a cross section of the wearable device 400. FIG. 4C shows a top view of another cross section of the wearable device 400.

As shown in FIGS. 4A and 4B, the wearable device 400 has a front cover 410 as a display. For example, the display may be a screen or a touch screen, and the cover may be glass or other suitable material. The front cover 410 has a first surface configured to face the user, and a second surface opposite the first surface. A housing 420 has a first side attached to the front cover 410, e.g., along the second surface thereof, to provide support and protection to various electronic and/or mechanical components of the wearable device 400. For example, as shown in FIGS. 4B and 4C, the various electronic and/or mechanical components inside the housing 420 may include the antenna system 100, a haptic motor 421, a battery 422, a speaker 423, a microphone 424, one or more sensors 425, and a circuit board 450 with a shielded can 452. The housing 420 may be made of any of a number of materials, for example, a metal, a ceramic, a plastic or combinations thereof.

Inside the housing 420, as shown in FIGS. 4B and 4C, a metal bezel 160 is attached to the housing 420. In this example, the radiating elements of the antenna system 100 are formed using portions of the metal bezel 160. The metal bezel 160 may also provide support and protection to some or all of the various electronic and/or mechanical components of the wearable device 400. In this example, the speaker 423, the microphone 424, and the sensors 425 are being supported by the metal bezel 160. The metal bezel 160 may also be attached to the front cover 410 to provide further support and protection to the front cover 410.

The metal bezel 160 may have one or more non-conductive slits, such as the first non-conductive slit 170 visible from the views of FIGS. 4A and 4C, and the second non-conductive slit 180 visible from the view of FIG. 4C. As described above with respect to FIG. 1, the first and second non-conductive slits 170 and 180 may be positioned at the ends of the first and second antennas 110, 120 to provide isolation between the portions of the metal bezel 160 that form the radiating elements 116, 126 of the first and second antennas 110, 120. For aesthetic reasons, the non-conductive slits 170 and 180 may be provided with a coating having a same color as the housing 420.

Remote from the front cover 410, a non-metallic back cover 430 is attached to a second side of the housing 420. In particular, a first surface of the non-metallic back cover 430 is attached to the second side of the housing 420. The non-metallic back cover 430 is configured to provide insulation between the various electronic components of the wearable device 400 and the wearer's skin. For example, the non-metallic back cover 430 may reduce body effects such as detuning, attenuation, and shadowing of the antennas 110 and 120 due to the wearer's skin. The non-metallic back cover 430 may also be configured to provide greater separation of the antenna system 100 from the wearer's skin than, for example, configuring the antenna system 100 in a wristband of the wearable device 400. The non-metallic back cover 430 may be made of any of a number of materials, for example, a ceramic, a glass, a plastic or combinations thereof. The non-metallic back cover 430 may also be attached to the metal bezel 160 as an additional source of support and protection.

Additionally, a back plate 440 is shown attached to a second surface of the non-metallic back cover 430, remote from the housing. The back plate 440 is configured to provide further insulation between the various electronic components of wearable device 400 and the wearer's skin. The back plate 440 may be made of any of a number of materials, for example, a glass, a ceramic, a plastic or combinations thereof. The combination of the non-metallic back cover 430 and the back plate 440 may provide greater separation of the antenna system 100 from the wearer's skin than having the non-metallic back cover 430 alone. This combination further reduces body effects such as detuning, attenuation, and shadowing of the antennas 110 and 120 due to the wearer's skin.

The wearable device 400 may be any of a number of wearable personal computing devices, such as a smartwatch, and may have specific dimension requirements due to the device type. For example, a smartwatch should fit comfortably on a wrist, be able to withstand some impact, have a screen large enough for displaying texts and simple graphics, and have enough space inside for various mechanical and electronic components, including a battery large enough not to require very frequent recharges. For example, the front cover 410 may have a length (x-direction) and/or width (y-direction) of 20-50 mm, and a height/thickness (z-direction) of 0.5-1 mm. The housing 420 may have a similar length and/or width as that of the front cover 410, and a height of 5-10 mm. The metal bezel 160 may have a similar length and/or width as that of the housing 420, and a height equal to or less than that of the housing 420, for example, 3-10 mm. The non-conductive slits 170 and 180 may each have a width of 1 mm-1.5 mm, a length less than a length of the metal bezel 160, and a height equal to or less than a height of the metal bezel 160. The non-metallic back cover 430 may have a similar length and/or width as that of the housing 420, and a height of 1-5 mm. The back plate 440 may have a length and/or width equal to or smaller than that of the non-metallic back cover 430, and a height of 1-3 mm. Although each exterior surface of the wearable device 400 is shown as having generally a rounded rectangular shape, the exterior surfaces of the wearable device 400 may alternatively be any of a number of geometric shapes, for example, a square, a circle, an oval, a triangle, or any other polygon, and have analogous dimension requirements as described above.

With these example dimension requirements, the ground plane 150 for the antennas 110 and 120 may be provided within the housing 420 of the wearable device 400. For example, the circuit board 450 with the shielded can 452 may be used as the ground plane 150 of the antennas 110 and 120. For example, the circuit board 450 and the shielded can 452 may each have a width and/or length of 15-45 mm. As shown in FIGS. 4B and 4C, a clearance d1 between the first antenna 110 and the circuit board 450 and/or the shielded can 452 may be 0.8-2 mm. Likewise, clearance distances d2 and d3 between the second antenna 120 and the circuit board 450 and/or the shielded can 452 may be 0.8-2 mm.

FIG. 5 shows an example system 500 in accordance with aspects of the disclosure. The example system 500 may be included as part of the example wearable device 400. The system 500 has one or more computing devices, such as computing device 510 containing one or more processors 512, memory 514 and other components typically present in a smartphone or other personal computing device. For example, the computing device 510 may be incorporated on the circuit board 450 of the wearable device 400 shown in FIGS. 4B and 4C. The one or more processors 512 may be processors such as commercially available CPUs. Alternatively, the one or more processors may be a dedicated device such as an ASIC, a single or multi-core controller, or other hardware-based processor.

The memory 514 stores information accessible by the one or more processors 512, including instructions 516 and data 518 that may be executed or otherwise used by each processor 512. The memory 514 may be, e.g., a solid state memory or other type of non-transitory memory capable of storing information accessible by the processor(s), including write-capable and/or read-only memories.

The instructions 516 may be any set of instructions to be executed directly (such as machine code) or indirectly (such as scripts) by the processor. For example, the instructions may be stored as computing device code on the computing device-readable medium. In that regard, the terms "instructions" and "programs" may be used interchangeably herein. The instructions may be stored in object code format for direct processing by the processor, or in any other computing device language including scripts or collections of independent source code modules that are interpreted on demand or compiled in advance. Functions, methods and routines of the instructions are explained in detail below.

User interface 520 includes various I/O elements. For instance, one or more user inputs 522 such as mechanical actuators 524, soft actuators 526, and microphone 424 are provided. For example, as shown in FIG. 4C, the microphone 424 is incorporated into the metal bezel 160. The mechanical actuators 524 may include a crown, buttons, switches and other components. The soft actuators 526 may be incorporated into a touchscreen cover, e.g., a resistive or capacitive touch screen, such as in the front cover 410 shown in FIGS. 4A-4B.

The user interface 520 may include various output devices. A user display 528, for example, a screen or a touch screen, is provided in the user interface 520 for displaying information to the user. For example, the user display 528 may be incorporated into the front cover 410 as shown in FIG. 4A-4B. The user interface 520 may also include one or more speakers, transducers or other audio outputs 530. For example, the audio output 530 may include the speaker 423 incorporated into the metal bezel 160, as shown in FIG. 4C. A haptic interface or other tactile feedback 540 is used to provide non-visual and non-audible information to the wearer. For example, the haptic interface 540 may be implemented with the haptic motor 421 inside the housing 420 as shown in FIGS. 4B and 4C. The user interface 520 also includes one or more cameras 542, for example the cameras 542 can be included on the housing 420, a wristband, or incorporated into the display 528.

The user interface 520 may include additional components as well. By way of example, one or more sensors 425 may be located on or within the housing 420. For example, as shown in FIG. 4C, the sensors 425 are incorporated into the metal bezel 160. The sensors 425 may include an accelerometer, e.g., a 3-axis accelerometer, a gyroscope, a magnetometer, a barometric pressure sensor, an ambient temperature sensor, a skin temperature sensor, a heart rate monitor, an oximetry sensor to measure blood oxygen levels, and a galvanic skin response sensor to determine exertion levels. Additional or different sensors may also be employed.

The system 500 also includes a position determination module 544, which may include a GPS chipset 546 or other positioning system components. Information from the sensors 425 and/or from data received or determined from remote devices (e.g., wireless base stations or wireless access points), can be employed by the position determination module 544 to calculate or otherwise estimate the physical location of the system 500.

In order to obtain information from and send information to remote devices, the system 500 may include a communication subsystem 550 having a wireless network connection module 552, a wireless ad hoc connection module 554, and/or a wired connection module 556. The communication subsystem 550 includes the antenna control circuit 558. For example, the antenna control circuit 558 controls the feeding of the antennas 110 and 120, and the aperture tuner 130 and the impedance tuner 140 of the antenna system 100. While not shown, the communication subsystem 550 has a baseband section for processing data, a transceiver section for transmitting data to and receiving data from the remote devices. The transceiver may operate at RF frequencies via one or more antennae, such as the antennas 110 and 120 of the antenna system 100.

The wireless network connection module 552 may be configured to support communication via cellular, LTE, 4G, WiFi, GPS, and other networked architectures. The wireless ad hoc connection module 554 may be configured to support Bluetooth®, Bluetooth LE, near field communications, and other non-networked wireless arrangements. And the wired connection 556 may include a USB, micro USB, USB type C or other connector, for example to receive data and/or power from a laptop, tablet, smartphone or other device.

The system 500 includes one or more internal clocks 560 providing timing information, which can be used for time measurement for apps and other programs run by the smartwatch, and basic operations by the computing device(s) 510, GPS 546 and communication subsystem 550.

The system 500 includes one or more power source(s) 570 providing power to the various components of the system. The power source(s) 570 may include a battery, such as battery 422, winding mechanism, solar cell or combination thereof. For example, as shown in FIGS. 4B and 4C, the battery 422 is included inside the housing 420. The computing devices may be operatively couples to the other subsystems and components via a wired bus or other link, including wireless links.

Unless otherwise stated, the foregoing alternative examples are not mutually exclusive, but may be implemented in various combinations to achieve unique advantages. As these and other variations and combinations of the features discussed above can be utilized without departing from the subject matter defined by the claims, the foregoing description of the embodiments should be taken by way of illustration rather than by way of limitation of the subject matter defined by the claims. In addition, the provision of the examples described herein, as well as clauses phrased as "such as," "including" and the like, should not be interpreted as limiting the subject matter of the claims to the specific examples; rather, the examples are intended to illustrate only one of many possible embodiments. Further, the same reference numbers in different drawings can identify the same or similar elements.

The invention claimed is:

1. A tunable antenna system for a wearable personal computing device, the tunable antenna system comprising:

a first antenna configured for a first set of frequency ranges;

a second antenna configured for a second set of frequency ranges;

an impedance tuner configured to tune the second antenna;

an aperture tuner configured to tune the second antenna;

a housing for the wearable personal computing device, a metal bezel disposed along the housing of the wearable personal computing device, wherein portions of the metal bezel form one or more radiating elements of the first antenna and one or more radiating elements of the second antenna, and wherein the impedance tuner and the aperture tuner are positioned within the metal bezel;

a first non-conductive slit positioned within the metal bezel between a second end of the first antenna and a first end of the second antenna; and a second non-conductive slit positioned within the metal bezel between a second end of the second antenna and a first end of the first antenna.

2. The system of claim 1, wherein the first non-conductive slit is in contact with the second end of the first antenna and the second non-conductive slit is in contact with the second end of the second antenna.

3. The system of claim 1, wherein at least one of the first non-conductive slit or the second non-conductive slit has a width within a range of 1 mm-1.5 mm.

4. The system of claim 1, wherein a clearance between a ground plane of the wearable personal computing device and at least one of the first antenna or the second antenna is within a range of 0.8 mm-2 mm.

5. The system of claim 1, wherein a ground plane of the wearable personal computing device has a length, width, or diameter of less than 40 mm.

6. The system of claim 1, wherein the second set of frequency ranges include one or more frequency ranges between 700 MHz and 2200 MHz for LTE signals.

7. The system of claim 1, wherein the first set of frequency ranges include one or more frequency ranges centered at 1575.42 MHz for GPS signals, or between 2400 MHz and 2484 MHz for WiFi signals.

8. The system of claim 1, wherein the second set of frequency ranges include one or more frequency ranges between 2500 MHz and 2700 MHz for LTE signals.

9. The system of claim 1, wherein the first non-conductive slit and second non-conductive slit are positioned symmetrically around the metal bezel.

10. The system of claim 1, wherein at least one of the impedance tuner or the aperture tuner is an active tuner.

11. A wearable electronic device, comprising:

a display device having a front cover configured to present information to a wearer of the wearable electronic device;

a housing having a first side attached to the front cover;

a metal bezel disposed along the housing of the wearable electronic device;

a plurality of antennas, wherein portions of the metal bezel form one or more radiating elements of the plurality of antennas;

one or more impedance tuners positioned within the metal bezel, the one or more impedance tuners being operatively connected to the plurality of antennas;

one or more non-conducive slits positioned within the metal bezel between each of the antennas; and a non-metallic back cover attached to a second side of the housing opposite the front cover.

12. The device of claim 11, further comprising:

a glass back plate attached to the non-metallic back cover remote from the front cover, the glass back plate being configured to contact a portion of a wearer of the wearable electronic device during use.

13. The device of claim 11, wherein at least one of the one or more non-conductive slits has a width within a range of 1 mm-1.5 mm.

14. The device of claim 11, wherein a clearance between a ground plane of the wearable electronic device and the plurality of antennas is within a range of 0.8 mm-2 mm.

15. The device of claim 11, wherein a ground plane of the wearable electronic device has a length, width, or diameter of less than 40 mm.

16. The device of claim 11, wherein the first non-conductive slit and second non-conductive slit are positioned symmetrically around the metal bezel.

17. The device of claim 11, wherein the one or more impedance tuners are operatively connected to one or more feeds of the plurality of antennas.

18. The device of claim 11, further comprising:

one or more aperture tuners positioned within the metal bezel, the one or more aperture tuners operatively connected to the plurality of antennas.

19. The device of claim 18, wherein the one or more aperture tuners are positioned inside the one or more radiating elements of the plurality of antennas.

* * * * *